United States Patent [19]

Vallance et al.

[11] 4,309,972

[45] Jan. 12, 1982

[54] CENTRIFUGAL ADVANCED SYSTEM FOR WAVE COMPRESSION SUPERCHARGER

[75] Inventors: James K. Vallance, Northville; Jeffrey A. Cook, Dearborn, both of Mich.

[73] Assignee: Ford Motor Company, Dearborn, Mich.

[21] Appl. No.: 99,245

[22] Filed: Dec. 3, 1979

[51] Int. Cl.[3] ..... F04F 11/00

[52] U.S. Cl. ..... 123/559; 417/64

[58] Field of Search ..... 417/64; 60/39.45 A; 123/559; 91/458

[56] References Cited

U.S. PATENT DOCUMENTS

| | | | |
|---|---|---|---|
| 2,715,891 | 8/1955 | Rodeck et al. | 91/458 X |
| 2,836,346 | 5/1958 | Jendrassik | 417/64 |
| 3,011,487 | 12/1961 | Berchtold | 60/39.45 A |
| 3,078,034 | 2/1963 | Spalding | 417/64 |
| 3,164,318 | 1/1965 | Barnes | 417/64 |

*Primary Examiner*—Louis J. Casaregola
*Assistant Examiner*—Edward Look
*Attorney, Agent, or Firm*—Frank G. McKenzie; Donald J. Harrington

[57] ABSTRACT

A wave compression supercharger comprises a rotor mounted for rotation about its longitudinal axis having axially disposed cells formed about its periphery, a shroud surrounding the rotor, a first port plate located between the rotor and an air duct that delivers ambient air to the supercharger rotor and delivers pressurized air to the air intake side of the engine. A second port plate located between the rotor and an exhaust duct carries low pressure gas from the rotor and high pressure engine exhaust gas to the rotor. A hydraulic cylinder has a piston mounted for sliding motion in the cylinder. A mechanical governor driven by the rotor of the supercharger controls a source of pressurized hydraulic fluid that is opened to the cylinder according to variations in the speed of the rotor. The piston is connected to a port plate and delivers a tangential force to the plate causing it to rotate with respect to the longitudinal axis of the rotor. An alternative embodiment causes a cam to be moved by the piston axially into engagement with cam surfaces formed on the port plate. When the cam is moved axially without rotation, the port plate assumes an advanced or retarded position with respect to the rotor.

3 Claims, 4 Drawing Figures

CENTRIFUGAL ADVANCED SYSTEM FOR WAVE COMPRESSION SUPERCHARGER

BACKGROUND OF THE INVENTION

1. Field of the Invention

This invention relates to a control for a wave compression supercharger and more particularly to such a control that adjusts the position of the engine exhaust gas inlet and outlet ports with respect to the ambient and compressed air inlet and outlet ports.

2. Description of the Prior Art

A wave compression supercharger is essentially a device for producing an exchange of pressure between the high energy state of the exhaust gas of an internal combustion engine and air at atmospheric pressure wherein the air is compressed in the supercharger and delivered to the intake manifold of the engine.

A conventional wave compression supercharger comprises a cylindrical rotor having radially-extending, straight-sided vanes extending from its outer surface enclosed in an outer cylindrical housing. Stationary port plates positioned at opposite ends of the rotor have openings formed through their thicknesses to allow exhaust gas and ambient air to flow into the rotor and the expanded exhaust gas and compressed air to flow from the rotor. The pressure exchange takes place within the rotor cells defined by the spaces on the outer surface of the rotor between adjacent vanes. The process for compressing the ambient air begins when a cell rotates into alignment with the air inlet port, thereby allowing ambient air to flow into the cell. The rotor than brings the cell into alignment with the high pressure exhaust gas inlet port at which time a compression wave enters the cell and begins to travel along the rotor length in the direction of the air port plates. This compression or shock wave travels ahead of the high pressure engine exhaust gas and operates to compress the air in the rotor cell as it travels axially toward the air port plate. The rotor will have rotated out of alignment with the air inlet port by the time the compression wave has begun to travel axially down the rotor.

For efficient operation, it is necessary that the compression wave reaches the air-side end of the cell precisely as the cell rotates out of alignment with the high pressure air exhaust port. This port must be sized and positioned carefully so that the rotor brings the cell to the port when the air in the cell has been compressed to a sufficient pressure but before the engine exhaust gas, located behind the compression wave, reaches the end of the cell and before it can exit the rotor through the port.

In a similar way the engine exhaust gas is purged from the rotor cell after the pressure wave rebounds from the air port plate surface. The rotor cell must rotate into alignment with the exhaust gas outlet port when the compression wave approaches the gas port plate; concurrently, at the air side of the rotor, the cell must be opened to ambient air during a portion of the return of the compression wave to the gas side so that a partial vacuum tending to resist movement of the returning compression wave is not produced.

In view of the timed sequence of events within a wave compression supercharger with respect to the rotor speed, the position and location of the gas and air inlet and outlet ports and of the progression and recession of the pressure wave along the rotor length, it can be appreciated that the device will operate efficiently generally at one speed only. However, the engine of the vehicle that drives the rotor must operate over a wide range of speed. It is, therefore, desirable to expand the efficient operating range of the supercharger to a greater portion of the speed range of the engine.

Wave compression superchargers have heretofore had the exhaust gas and air port plates fixedly mounted in relation to the rotor. The various design parameters relating to the size and location of the ports and length of the rotor are chosen to produce an optimum performance at a single engine speed. The most efficient operation of conventional superchargers, consequently, occurs at the engine speed for which the design parameters are compatible; but efficiency is markedly reduced at engine speeds greater and less than that value.

SUMMARY OF THE INVENTION

The wave compression supercharger of our invention provides a means whereby the optimum operating speed range of the supercharger is extended beyond the single speed at which conventional superchargers have been restricted. This result is realized by providing air and gas inlet port plates that are mounted to allow angular adjustment, hence variable inlet and exhaust port locations, as the rotor speed varies. A system is provided to automatically reposition the port plates for optimal performance to assure the proper relationship exists among the rotor speed and the positions of the inlet and exhaust ports. A hydraulically actuated piston applies a tangentially directed force to the air port plate and operates to cause its rotation about the central axis of the rotor. The cylinder in which the pistons are located receives pressurized hydraulic fluid metered through a governor valve. The valve is opened and closed according to control exercised by a governor mounted on the supercharger shaft. When the rotational speed of the engine increases, the governor valve causes the pressurized fluid to be admitted to the cylinder, thereby actuating the piston which rotates the port plate into a port-advance position. When the governor senses a reduction in shaft speed, the governor valve closes off communication between the cylinder and the hydraulic pressure source and a mechanical spring operates to return the movable port plate to a retarded position.

The variable position port plate can be rotated into an advanced and retarded position by other means than the piston and spring. For example, a worm gear having external helical teeth can be arranged in meshing engagement with a complimentary surface formed on a central bore in the port plate. When rotor speed changes, hydraulic fluid is admitted to the cylinder in the case where rotor speed increases, and is disconnected from the cylinder when rotor speed decreases, according to the control exercised by the governor and the governor valve. Piston movement, in this case, causes the cam to advance and to retract axially without rotation within the part plate bore, thereby producing rotation of the port plate to the advance and retard positions.

DESCRIPTION OF THE PREFERRED EMBODIMENT

Figure 1:
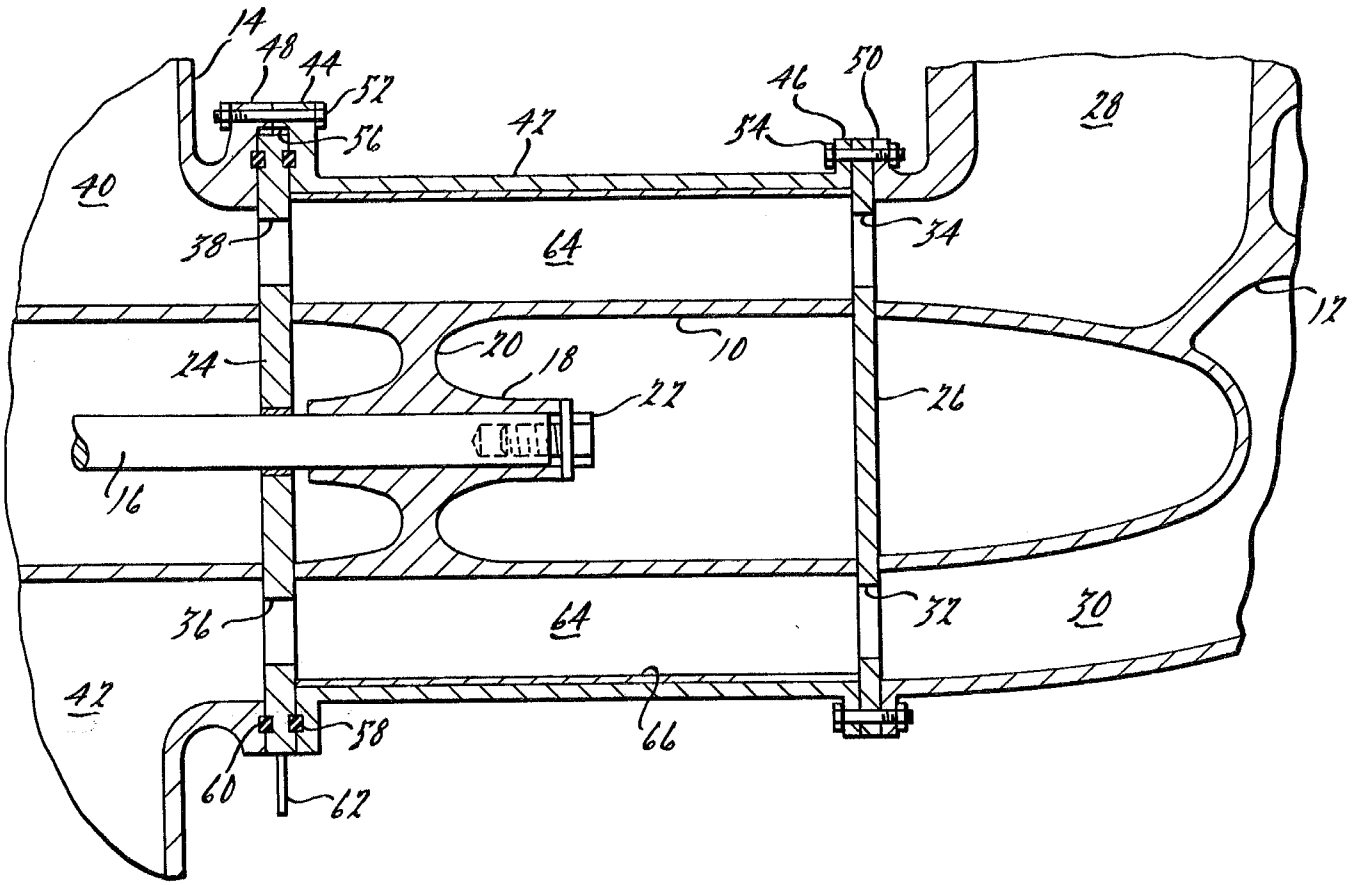
FIG. 1 is a cross sectional view through the plane of the rotor center of a compression wave supercharger.

Turning first to FIG. 1, a wave compression supercharger is shown in cross section having a cylindrical rotor 10 disposed between an exhaust gas duct 12 and an air duct 14. A rotor shaft 16 extends axially along the supercharger and is driven in rotation by a belt (not shown), which is in turn driven by the engine of the vehicle. The shaft 16 is mechanically joined by an attachment bolt 22 to the rotor at a central boss 18 that extends radially inwardly from a web portion 20 of the rotor. An air port plate 24 mounted for rotation on the shaft 16 is located between an axial end of the rotor an the air duct 14. An exhaust gas port plate 26 is positioned between the axially opposite end of the rotor and the exhaust gas duct 12.

The exhaust gas duct 12 includes an inlet passage 28 that communicates with the exhaust gas side of the engine and carries the hot, high-pressure exhaust gas into the supercharger rotor. Also formed in the exhaust gas duct is an exhaust gas outlet passage 30 adapted to carry the engine exhaust gas after it has been expanded within the supercharger and after it has passed through the gas outlet port 32. The high temperature exhaust gas is admitted to the rotor through the gas inlet port 34, which is formed through the thickness of the gas port plate 26 as is the gas outlet port 32.

Similarly, the air port plate 24 has at least two ports formed through its thickness, an air inlet port 36, through which low-pressure air at ambient conditions flows into the rotor, and an air outlet port 38, through which compressed air at a higher pressure flows from the rotor into the high pressure air passage 40. The air duct includes a low pressure air passage 42, which directs the ambient air through the port 36 into the rotor 10, and the air passage 40, which carries the compressed air to the air intake side of the engine.

An outer shroud 42 having a cylindrical inner surface is positioned over the rotor and provides flanges 44, 46 that abut flanges 48, 50 formed respectively in the air duct 14 and the exhaust gas duct 12. The flanges 44, 48 are mechanically joined by attachment bolts 52, and the flanges 46, 50 are mechanically joined by attachment bolts 54.

The flange 44 of the shroud 52 and the flange 48 of the air duct 14 provide a space 56 in which the air port plate 24 is located. When the mechanical attachment 52 is drawn up, the space 56 is not brought into abutting contact with the surfaces of the port plate 24, but instead continues to provide a clearance so that the port plate 24 is free to move with respect to the axis of the shaft 16. Seals 58, 60 are fitted in recesses formed on the surfaces of the air port plate 24 and provide an airtight seal for the space 56 that permits rotational movement of the plate 24 on the shaft 16. The port plate 24 has a radially directed arm portion 62 extending from its radially outermost surface.

A plurality of vanes 64 is mounted on the outer surface of the rotor 10. Each vane is formed of a thin sheet of metal and is spaced from adjacent vanes by approximately 10 degrees around the circumference of the rotor. The radially innermost edge of each vane is brazed or welded to the rotor surface and the radially outermost edge is brazed or welded to the inner surface of a sleeve 66, which is interposed between the shroud and the vanes.

Figure 2:
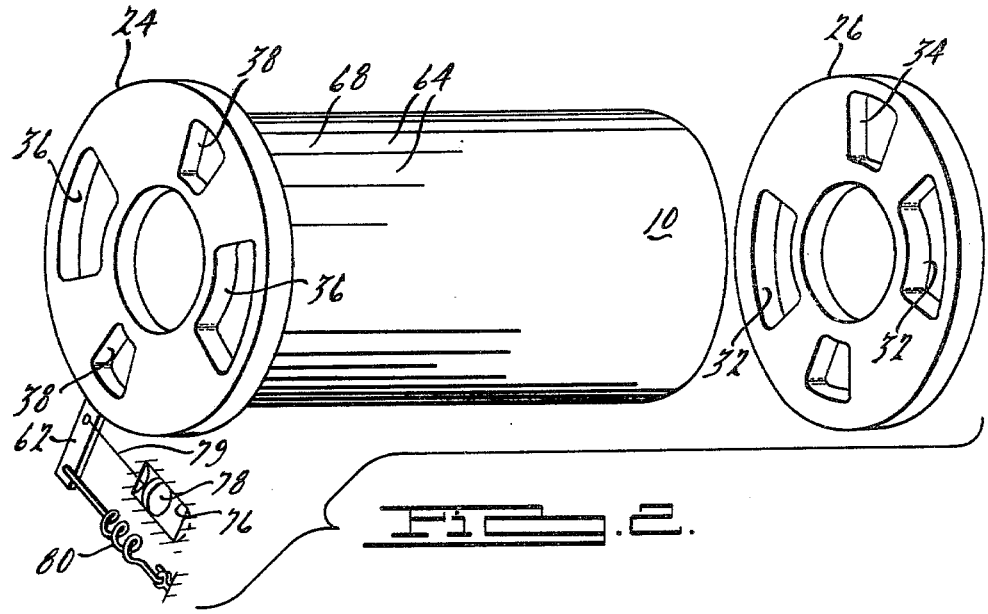
FIG. 2 shows the air and exhaust gas ports spaced by the rotor, the air port plate being adapted to receive tangentially directed forces applied by the hydraulic actuated control system tending to rotate the plate about the central axis.
Figure 3:
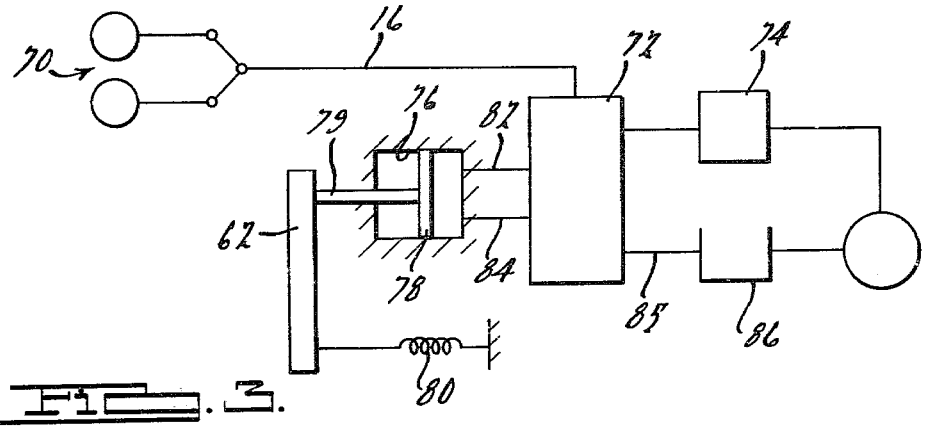
FIG. 3 shows schematically a hydraulically actuated port plate position control for a wave compression supercharger whose shaft speed variations cause the control to energize and de-energize a hydraulic cylinder.

FIG. 2 shows a portion of a supercharger that includes the air port plate 24 and the exhaust gas port plate 26 spaced at oppposite ends of rotor 10, which has the vanes 64 extending from its outer surface. FIGS. 2 and 3 illustrate air and exhaust gas port plates that have two inlet and outlet ports formed therethrough. The spaces bounded by adjacent vanes 64, by the outer surface of the rotor 10 and by the inner surface of the outer sleeve 66 define rotor cells 68 into which the exhaust gas and air are admitted. Operation of the wave compression supercharged for use with the control system according to this invention is described in the patent application Ser. No. 32,324, filed Apr. 23, 1979, which is incorporated herein by reference. As is more completely described in the reference application, the engine exhaust gas passes through the exhaust gas inlet passage 28 and gas inlet port 24 and into a rotor cell 68 when the rotor cell has been rotated into general alignment with the gas inlet port 34. Before the engine exhaust gas enters the rotor cell 68, however, this cell had been filled with air at ambient conditions that entered the rotor through the air inlet port 36 when the rotor cell 68 was aligned with the air inlet port 36. The ambient air was directed through the port 36 by the low pressure air passage 42 formed in the air duct 14. When the pressure exchange between the high pressure exhaust gas and the low pressure air is completed, the rotor will have rotated into approximate alignment with the air outlet port 38 thereby causing the compressed air to flow from the rotor into the high pressure air passage 40 and subsequently to the intake manifold of the engine. The expanded engine exhaust gas exits the rotor cell 68 when the cell is brought into alignment with the gas outlet port 32. The low pressure exhaust gas is returned to the engine exhaust gas system through the gas oulet passage 30.

In order to vary the position of either the air port plate 24 or the exhaust gas port plate 26 with respect to the rotor cell when the engine speed varies, the control system shown schematically in FIG. 3 operates upon the port plate 24 to alter its position. In the description that follows, reference is made solely to the interaction of the control system with the air port plate, but the invention is as well adapted to alter the relative position of the exhaust gas port plate 26. Alternatively, both the exhaust gas port plate 26 and the air port plate 24 can be repositioned with respect to the rotor by the control system according to this invention.

FIG. 3 shows the rotor shaft 16 having governor 70 mounted thereon and adapted to open a control valve 72 that is located in a hydraulic circuit that connects a pressure tank 74 to a hydraulic cylinder 76, which has a piston 78 slidably mounted therein and connected to the arm 62 of the port plate 24 by the piston rod 79. A mechanical spring 80 fixed to the vehicle at one end is also connected to the arm 62 at its opposite end and is adapted to return the port plate to an original position when cylinder 76 is deactivated. Hydraulic fluid is delivered to the cylinder 78 in the hydraulic line 82 and is returned from the cylinder to a sump 86 though the control valve 72 by way of the hydraulic lines 84, 85. A hydraulic pump, which may be the oil pump for the vehicle, maintains the control system in a pressurized condition.

In operation, when the shaft speed increases, the governor 70 opens the control valve 72 to allow pressurized hydraulic fluid to be delivered from the pressure tank 74 in hydraulic line 82 to the cylinder 76. This actuates the piston 78 and causes it to move outwardly within the cylinder 76. The piston being attached to the arm 62 applies a tangential force to the port plate 24 thereby causing it to be repositioned with respect to the rotor. When the rotor shaft speed is reduced, the governor 70 causes the control valve to close off the flow of hydraulic fluid to the cylinder 76 and to open passage of hydraulic fluid to lines 84, 85 for delivery to the sump 86. When this occurs, the cylinder is deactivated. The piston 78 is caused to return to its original position at the head of the cylinder by the action of the mechanical spring 80, which applies a restoring force to the arm 62 in opposition to the piston force. The port plate 24 is, therefore, returned to its original position or to any position corresponding to the speed at which the shaft 16 is rotating.

Figure 4:
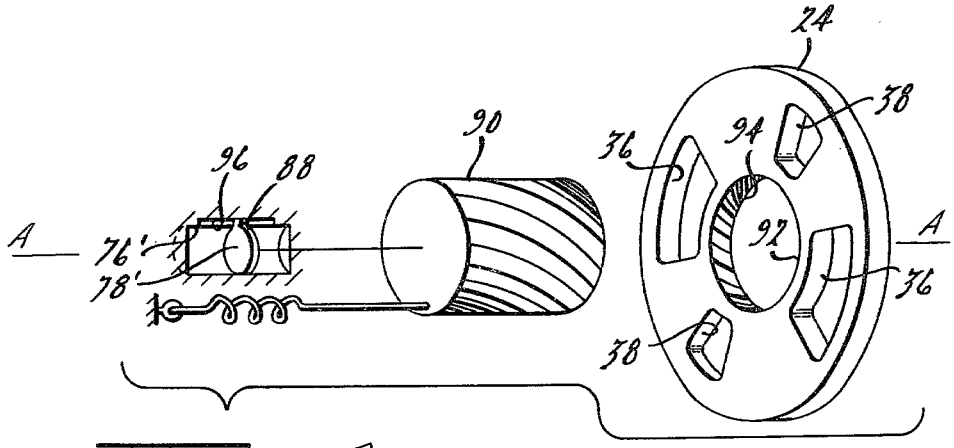
FIG. 4 illustrates an embodiment of the port plate position control wherein a cam having external helical surfaces that engage complementary and mating surfaces formed on a central bore of the port plate is advanced and retracted without rotation through the bore.

Instead of the piston directing a tangential force toward the periphery of the port plate 24, in the embodiment illustrated in FIG. 4, a cam 90 is made to move axially within a central bore 92 formed through the thickness of the port 24. The bore 92 has cam surfaces 94 formed thereon that mate with and engage the corresponding cam surfaces formed on the outer contour of the cam 90. When the rotor speed increases, the control valve 72 opens the flow of pressurized hydraulic fluid in line 82 to the cylinder 76'. The piston 78', which has an extension 88 that is seated within a notch 96 formed in the cylinder wall, is moved axially outwardly from the cylinder causing the cam 90 to move axially without rotation through the bore 92. The cam 90 and the piston 78' are adapted for axial movment only; rotation about the central axis A-A is prevented by the mechanical restraint existing between the extension 88 of the piston and the walls of the cylinder. When the cam 90 engages the surfaces 94 and is moved axially through the bore 92, the air port plate 24 is made to rotate about the central axis, and the air inlet port 36 and outlet ports 38 are repositioned with respect to the rotor.

Changes and modifications in the specifically described embodiment can be carried out without departing from the scope of the invention which is intended to be limited only by the scope of the appended claims.

Having thus described a preferred embodiment of our invention, what we claim and desire to secure by U.S. Letters Patent is:

1. A wave compression supercharger for compressing air supplied to an engine comprising:

a rotor mounted for rotation about its axis, including a hub and axially disposed cells formed about the periphery of the hub;

a shroud surrounding said rotor;

an exhaust gas duct having a low pressure exhaust gas passage and a high pressure exhaust gas passage communicating with the exhaust gas side of the engine;

an air duct having a high pressure air outlet passage communicating with the air intake side of the engine and a low pressure air inlet passage;

a first port plate disposed between said rotor and said air duct having formed therein a low pressure air inlet port and a high pressure air outlet port communicating respectively with a low pressure passage and a high pressure passage of the air duct;

a second port plate disposed between said rotor and said exhaust gas duct having formed therein a low pressure gas outlet port and a high pressure gas inlet port communicating respectively with the low pressure passage and the high pressure passage exhaust gas duct, at least one of said port plates having a cam follower surface formed thereon;

means providing a cam surface mounted for axial movement parallel to the axis of said rotor and engaging the cam surface of said port plate; and means for moving the cam surface axially into engagment with the cam follower surface thereby causing the port plate to rotate about the longitudinal axis of the rotor.

2. The supercharger according to claim 1 wherein the means for moving the cam surface includes a source of pressurized hydraulic fluid;

a hydraulic cylinder having a piston mounted for sliding motion within the cylinder as hydraulic pressure is applied to and withdrawn from said cylinder;

valve means connecting and disconnecting communication between the source of pressurized hydraulic fluid and the hydraulic cylinder;

a mechanical governor responsive to variations in the rotational speed of the rotor for opening and closing the valve means whereby sliding motion of said piston moves the cam surface axially into engagment with the cam follower surface of said port plate thereby causing the port plate to rotate about the longitudinal axis of the rotor.

3. The supercharger according to claim 1 wherein said first and second port plates have cam follower surfaces and wherein the cam surface means engages the cam follower surfaces of said first and second port plates thereby causing said port plates to rotate about the longitudinal axis of the rotor.

* * * * *